United States Patent [19]

Ganesan et al.

[11] Patent Number: 4,784,830

[45] Date of Patent: Nov. 15, 1988

[54] HIGH NICKEL CHROMIUM ALLOY

[75] Inventors: Pasupathy Ganesan; Gaylord D. Smith; Curtis S. Tassen, all of Huntington; Jack M. Wheeler, Lesage, all of W. Va.

[73] Assignee: Inco Alloys International, Inc., Huntington, W. Va.

[21] Appl. No.: 59,750

[22] Filed: Jun. 8, 1987

Related U.S. Application Data

[63] Continuation-in-part of Ser. No. 881,623, Jul. 3, 1986, abandoned.

[51] Int. Cl.[4] ..... C22C 19/05

[52] U.S. Cl. ..... 420/443; 148/428; 420/446; 420/447; 420/448; 420/449; 420/450

[58] Field of Search ..... 420/446, 447, 448, 449, 420/450, 443; 148/428

[56] References Cited

U.S. PATENT DOCUMENTS

| | | | |
|---|---|---|---|
| 2,813,788 | 11/1957 | Skinner | 420/584 |
| 3,160,500 | 12/1964 | Eiselstein et al. | 420/448 |
| 3,574,604 | 3/1971 | Copson et al. | 420/446 |
| 3,607,243 | 9/1971 | Eiselstein et al. | 420/446 |
| 4,312,682 | 1/1982 | Herchebroeder | 420/443 |
| 4,448,749 | 5/1984 | Sugitani et al. | 420/584 |
| 4,487,744 | 12/1984 | DeBold et al. | 420/584 |
| 4,547,338 | 10/1985 | Grobner et al. | 420/584 |

*Primary Examiner*—R. Dean

*Attorney, Agent, or Firm*—Raymond J. Kenny; Francis J. Mulligan

[57] ABSTRACT

An oxidation resistant nickel-chromium based alloy possessing good stress rupture characteristics at elevated temperature and, in addition to nickel and chromium, containing correlated percentages of aluminum, titanium, nitrogen, carbon, etc.

20 Claims, No Drawings

HIGH NICKEL CHROMIUM ALLOY

The present application is a continuation-in-part of Ser. No. 881,623 filed on July 3, 1986, abandoned.

The subject invention is directed to a high nickel-chromium-iron alloy, and more particularly to a Ni-Cr-Fe alloy of special chemistry and micro-structure such that it is capable of affording a desired combination of properties at elevated temperature upwards of 2000° F. (1093° C.) under oxidizing conditions.

BACKGROUND OF THE INVENTION

Since at least the early 50's, the demand has been incessant for economical materials capable of performing satisfactorily under increasingly severe operating conditions, notably temperature. For example, and by way of illustration, in the ceramic tile industry frit-firing temperatures have been on the increase in an effort to accomodate new frits and higher furnace loads, this to remain competitive in the market-place. Initially, various manufacturers of furnace rollers for this application used an alloy containing roughly 0.04% C, 0.25% Si, 0.25% Mn, 22.75% Cr, 0.4% Ti, 0.01% Nb, 1.35% Al, 59.5% Ni, 0.35% Co, 0.03% N, 0.001% $O_2$, balance essentially iron, the alloy being produced from ingots melted in an air induction furnace. The service life of the rollers lasted up to roughly 18 months at 2060° F. (1127° C.), ultimately failing from oxidation-enhanced stress-rupture failure with fracture being intergranular.

More recently, the rollers have been produced from electric-arc furnace melted, argon-oxygen decarburized (AOD) refined ingots. The composition used differed somewhat from the above, a typical composition being approximately 0.03%C., 0.3% Si, 0.3% Mn, 22.5% Cr, 0.4% Ti, 0.02% Nb, 1.27% Al, 60.8% Ni, 0.08% Co, 0.29% Mo. 0.015% N, less than 0.001% $O_2$, and balance essentially iron. At 2050° F. (1121° C.) rollers lasted some 12 months and at times longer. However, at 2130° F. (1165° C.) such rollers manifested failure in 2 months or less.

From our investigation of the problem it would appear that failure is caused by a rather dramatic change in microstructure as temperature is increased. This was not initially or readily apparent since our first approach was to increase the levels of aluminum and chromium to enhance oxidation behavior. But this was not a panacea. In any case, extensive experimentation reflects that circa 2150° C. (1177° C.), and above there is a lack of microstructural control of grain size. It would appear that the $M_{23}C_6$ carbide, stabilized by silicon and molybdenum, but consisting mainly of chromium, begins to redissolve into the matrix. This frees the grain boundaries to migrate under applied stress and results in coarse or massive grains, e.g., one to three grains across the wall thickness, 0.080 in. (2.0 mm), of the rollers. This can be viewed, at least in part, as failure induced by the alternating tensile and compressive stresses set up in the rollers as a consequence of temperature and time. Actually, many grain boundaries appear to be perpendicular to the roller surface and serve as sites for preferential grain boundary oxidation attack which, in turn, leads to premature grain boundary rupture.

SUMMARY OF THE INVENTION

It has now been found that the oxidation resistance of alloys of the type above-discussed can be improved by a controlled addition and retention of nitrogen as discussed infra. Put another way, it has been discovered that the microstructure of the alloys of the type under consideration, notably grain size, can be controlled or rendered relatively structurally stable over extended periods at elevated temperature through a microalloying addition of nitrogen. In addition, and most advantageously, a special ratio of silicon to titanium should be observed in seeking extended service life as will be shown herein.

INVENTION EMBODIMENTS

Generally speaking and in accordance with the present invention, the alloy contemplated herein contains about 19 to 28% chromium, about 55 to 65% nickel, about 0.75 to 2% aluminum, about 0.2 to 1% titanium, up to about 1% or 1.5% silicon, up to about 1% each of molybdenum, manganese, and niobium, up to 0.1% carbon, from about 0.04 or 0.045 to 0.08% or 0.1% nitrogen, up to 0.01% boron and the balance essentially iron. As above indicated, a special correlation between silicon and titanium should be maintained. In this connection, this correlation should be such that the ratio of silicon to titanium should be from 0.8 to 3.

A preferred alloy contains 21 to 25% Cr, 58 to 63% Ni, 1 to 2% Al, 0.3 to 0.7% Ti, 0.1 to 0.6% Si, 0.1 to 0.8% Mo, up to 0.6% Mn, up to 0.4% Nb, 0.02 to 0.1%C, 0.04 to 0.08% N, with iron being essentially the balance. Again, it is most preferred that a ratio of silicon to titanium of at least 0.85 be adhered to.

Nitrogen plays a major role in effectively enhancing oxidation resistance. It forms a nitride and/or carbonitride with titanium, approximately 0.15 to 0.8% TiN depending upon the stoichiometry of the nitride. This level of TiN pins the grain size at temperatures as high as 2192° F. (1200° C.), and stabilizes grain size, which, in turn, causes a marked increase in operating life, circa as long as 12 months or longer, at the much higher temperature of 2192° F. (1200° C.). Put another way the presence of nitrogen/nitride increases the temperature capability over conventionally used materials by some 135° F. (75° C.) or more. Below about 0.04% nitrogen (0.17% stoichiometric TiN) there would appear to be insufficient precipitate to pin the grain boundaries. Above about 0.08% (non-stoichiometric TiN) the alloy tends to become difficult to manufacture and difficult to weld. Apart from the foregoing advantage of this microalloy addition, stress-rupture life is increased, thus, permitting furnace operators to increase load bearing capacity at temperature without a detrimental sacrifice in roller life.

In carrying the invention in practice, care should be exercised in achieving proper composition control. Nickel contributes to workability and fabricability as well as imparting strength and other benefits. Aluminum and chromium confer oxidation resistance but if present to the excess lend to undesirable microstructural phases such as sigma. Little is gained with chromium levels much above 28% or aluminum levels exceeding 2%.

Carbon need not exceed 0.1% to minimize the formation of excess carbides. A level of about 0.1 to 0.5% $Cr_{23}C_6$ aids strength to about 2057° F. (1125° C.). This is particularly true if one or both of silicon and molybdenum are present to stabilize the carbide phase. In this regard the presence of 0.1 to 0.6% silicon and/or 0.1 to 0.8% molybdenum is advantageous.

Titanium acts minimally as a malleabilizer as well as serving to form the grain boundary pinning phase, TiN.

Niobium will further stabilize the nitride and/or carbonitride phase and from 0.05 to 0.4% is beneficial, particularly in the presence of titanium. While niobium might be used in lieu of titanium, it is preferred to use the latter since niboium is of a higher density and as a consequence a greater amount of a more costly metal (based on equivalent weights) would be required. Too, niobium nitride forms at a higher temperature than TiN and is more readily dissolved back into the metal matrix. NbN is not quite as stable as TiN.

As noted above herein, control of the percentages of silicon and titanium should be exercised. At elevated temperature, e.g., 2000° F. and above, "scale integrity", as reflected by imperviousness to the atmosphere of exposure and adhesion tenacity of the scale to the alloy surface, particularly during thermal cycling, is most important. We have found that silicon manifests a marked positive influence in respect of scale integrity whereas titanium tends to detract therefrom. The ratio therebetween need not exceed 3 and highly satisfactory results are achieved upon alloy exposure to air at 2000° F. and above with silicon to titanium ratios of 0.9 to 1.4 or 1.5. A silicon content of at least 0.2 or 0.25% is most preferred. It is thought that other properties could be adversely impacted should the upper limits of both silicon (1.5%) and titanium (1%) be employed. The ratio may be extended downwardly to about 0.75 but at the risk of poorer results. It is considered that what has been found in terms of silicon to titanium should be followed should niobium is used in lieu of titanium.

With regard to other elements, manganese is preferably held to low levels, preferably not more than about 0.6%, since higher percentages detract from oxidation resistance. Up to 0.006% boron may be present to aid malleability. Calcium and/or magnesium in amounts, say up to 0.05 or 0.1%, are useful for deoxidation and malleabilization.

Iron comprises essentially the balance of the alloy composition. This allows for the use of standard ferroalloys in melting thus reducing cost. As to other constituents, sulfur and phosphorous should be maintained at low levels, e.g., up to 0.015% sulphur and up to 0.02 or 0.03 phosphorous. Copper can be present.

In terms of processing, conventional air melting procedures may be used, including the employment of induction furnaces. However, vacuum melting and refining can be employed where desired. Preferably the alloy is electric-arc furnace melted and AOD refined. The nitrogen can be added to the AOD refined melt by means of a nitrogen blow. The alloy is, as a practical matter, non age-hardenable or substantially non age-hardenable, and is comprised essentially of a stable austenitic matrix virtually free of detrimental quantities of subversive phases. For example, upon heating for prolonged periods, say 300 hours, at temperatures circa 1100° F. (593° C.) to 1400° F.(760° C.) metallographic analysis did not reveal the presence of the sigma phase. If the upper levels of both aluminum and titanium are present, the alloy, as will be apparent to a metallurgist, is age hardenable.

The following information and data are given to afford those skilled in the art a better perspective as to the nature of the alloy herein abovedescribed:

A series of alloys (Table I) were melted in either an air induction furnace (Alloys E and 1), or in a vacuum induction furnace (Alloy C), or in an electric-arc furnace (Alloys A, B, 2 and 3), then AOD refined. Alloy D was melted in an electric-arc furnace, AOD refined and then ESR remelted. Ingots were broken down to approximately 0.280 inch hot bands which were then cold rolled in coils to approximately 0.080 in. 0.080 in. thickness with two intermediate anneals at 2050° F. (1121° C.). Sheet specimens were annealed at about 2150° F. (1177° C.) prior to test. A metallographic examination was then conducted upon exposing each alloy for either 16 hour increments at 2012° F. (1100° C.) and 2192° F. (1200° C.) or 100 hour increments at 2130° F. (1165° C.) to measure grain growth versus time at various temperatures. The data are reported in Table II.

TABLE I

| Alloy | N | C | Cr | Al | Fe | Ni | Si | Mo | Cb | Mn | Ti |
|---|---|---|---|---|---|---|---|---|---|---|---|
| A | 0.011 | 0.023 | 21.94 | 1.16 | 15.54 | 60.44 | 0.17 | 0.48 | 0.18 | 0.36 | 0.38 |
| B | 0.02 | 0.035 | 23.01 | 1.31 | 13.73 | 61.13 | 0.18 | 0.18 | 0.08 | 0.33 | 0.38 |
| C | 0.005 | 0.078 | 23.78 | 1.78 | 13.42 | 59.53 | 0.51 | 0.001 | 0.001 | 0.52 | 0.01 |
| D | 0.029 | 0.047 | 23.37 | 1.75 | 13.42 | 59.66 | 0.41 | 0.20 | 0.12 | 0.31 | 0.36 |
| E | 0.05 | 0.04 | 23.56 | 1.95 | 14.00 | 59.03 | 0.51 | 0.001 | 0.001 | 0.50 | 0.01 |
| 1 | 0.08 | 0.04 | 23.89 | 1.51 | 11.61 | 61.17 | 0.32 | 0.23 | 0.001 | 0.29 | 0.37 |
| 2 | 0.05 | 0.05 | 23.46 | 1.36 | 15.14 | 59.03 | 0.45 | 0.37 | 0.36 | 0.23 | 0.21 |
| 3 | 0.04 | 0.06 | 23.87 | 1.44 | 13.59 | 59.97 | 0.51 | 0.47 | 0.33 | 0.35 | 0.24 |

composition in weight percentage
oxygen less than 0.005% where determined

TABLE II

EFFECT OF THERMAL EXPOSURE FOR VARIOUS TIMES AND TEMPERATURES
Surface Grain Size in mils (0.001 in.)

| Alloy | A | B | C | D | E | 1 | 2 | 3 |
|---|---|---|---|---|---|---|---|---|
| Annealed Grain Size | 5 | 3.5 | 5 | 5 | 2 | — | 3 | 3 |
| 1100° C. (2010° F.)/ 16 hours | 8 | 3.5 | 5 | 8 | 3 | — | 3 | 3 |
| 1200° C. (2190° F.)/ 16 hours | 25.0 | 14.0 | 7 | 14 | 8 | — | 10 | 10 |
| 1165° C. (2130° F.)/ 100 hours | 25 | 25 | 12* | 12 | 14 | 5 | 8 | 7 |
| 1165° C. (2130° F.)/ 200 hours | — | 30 | 14 | 12 | — | 5 | 8 | 7 |
| 1165° C. (2130° F.)/ 300 hours | 24 | 40 | 24 | 12 | 14 | 5 | 7 | 7 |
| 1165° C. (2130° F.)/ 400 hours | 28 | 50 | 14 | 14 | — | 5 | 7 | 7 |
| 1165° C. (2130° F.)/ 500 hours | 42 | 80** | 17 | 14 | — | 5 | 8 | 8 |
| 1165° C. (2130° F.)/ 600 hours | 80** | — | 25 | 12 | — | 5 | 8 | 8 |

12* = Exposed 144 hours in field service at 1165° C. (2130° F.) prior to grain size experiments (initial grain size was 12 mils)
80** = Single grains across the gauge Alloys A through C are low nitrogen compositions with varying carbon content. Although increasing carbon content progressively inhibited grain growth, it was ineffective in controlling grain size for long periods of time above about 1100° C. (2010° F.). The increased nitrogen level of Alloy 1 results in several beneficial attributes. The uniform dispersion of nitride resulted in stabilization of the grain size and longer stress rupture lives at elevated temperature. The oxidation resistance of the alloy was also improved (surprisingly) as measured by the reduction of the denuded zone beneath the surface scale (Table III). The nitrogen level of Alloy D was also beneficial in comparison with A, B and C but it is deemed that Alloy D would not perform as well as Alloy 1 over prolonged periods as is indicated by the data in Table II. Alloy E when placed in service failed in eight days. While the nitrogen content was within the invention, the alloy was virtually titanium free.

Alloys A and B were fabricated into 26.9 mm diameter (1.06 in)×2438.4 mm (96 in.) rollers using 2.0 mm (0.08 in.) gauge sheets and then field tested in an actual furnace operating at 1165° C. (2130° F.). Both alloys failed by stress rupture in a short time. Alloy A failed in less than a month and B had a 40% fracture rate in only 40 days. Alloy C was hot worked into a solid bar 26.9 mm (1.06 in.) diameter and placed in field operation for 6 days. The average grain size was 12 mils. after exposure with grains as large as 60 mils. The stress rupture life of an alloy similar to alloy A at 1177° C. (2150° F.) and 6.89 MPa (1 Ksi) was 308 hours.

Alloys 1, 2 and 3, D and E were fabricated similarly and exposed to the same thermal conditions as alloys A through C. (Alloys D, E and 1, 2 and 3 are of intermediate carbon content compositions with increasing nitrogen levels). The beneficial effect of increasing nitrogen content on grain size stability is demonstrated by the data in Table II. Rollers were fabricated from Alloy 1, 2 and 3 (and also D) as described for Alloys A and B and are currently in field service without incident. Alloy E was fabricated into a solid roller as described for Alloy C. This alloy which was tested in field service at 1165° C. (2130° F.) for 8 days was metallographically evaluated for grain size. The grain size was 12 mils after exposure and 2 mils prior to exposure. The stress rupture life of an alloy composition similar to Alloy E at 1177° C. (2150° F.) and 6.89 MPa (1Ksi) was 507 hours. This increase in stress rupture life over, for example, alloy A demonstrates a contribution to strength by the nitrogen addition. Likewise alloy D was stress rupture tested at 1090° C. (2000° F.) and 13.78 MPa (2 Ksi) along with an alloy similar to Alloy C. The times to failure were a maximum of 224 and 157 hours, respectively. Again, the contribution to strength by the nitrogen addition was noted.

In manufacturing the furnace rollers, all the above alloys were autogeneous welded using tungsten-arc argon-shielded welding procedures. No difficulties in welding were encountered. However, at higher than 0.08% nitrogen welding problems might ensue.

As indicated herein, electric-arc furnace melting, AOD refining with a nitrogen blow is the preferred manufacture route over air induction furnace melting of the ingots because of improved yield to final product and because of the better dispersion of the nitrides. An additional and unexpected benefit of the nitrogen additions is a marked reduction of the depth of the denuded zone (depletion of chromium and aluminum contents) as the nitrogen content is increased. Table III shows the depth of the denuded zone for alloys C, D and 1. This dramatic increase in resistance to alloy depletion in the base alloy is attributed to the effect of nitrogen on grain size retention and concomitantly on oxide scale density and tenacity.

TABLE III

EFFECT OF NITROGEN ON THE DEPTH OF THE DENUDED ZONE AFTER 600 HOURS AT 1165° C. (2130° F.)

| Alloy | Depth of Denuded Zone (mils) |
|---|---|
| C | 50 |
| D | 12 |
| 1 | 6 |

With regard to the aforediscussed silicon/titanium ratio, data are given in Table V infra concerning oxidation performance in a ceramic frit-firing furnace operating at about 2130° F. under an air atmosphere. Mass change data are also presented in Table V with respect to Alloys A, B, G, 2, 3, 5 and 6. A 24 hour cyclic test was conducted in air at 2000° F. (1093° C.) for 984 hours.

Little spalling occurred in respect of the alloys within the invention. Chemistries for the alloys are reported in Table IV.

TABLE IV

| Alloy | N | C | Cr | Al | Fe | Ni | Si | Mo | Nb* | Mn | Ti |
|---|---|---|---|---|---|---|---|---|---|---|---|
| A | 0.011 | 0.023 | 21.94 | 1.16 | 15.54 | 60.44 | 0.17 | 0.48 | 0.18 | 0.36 | 0.38 |
| B | 0.02 | 0.04 | 23.01 | 1.31 | 13.73 | 61.13 | 0.18 | 0.18 | 0.08 | 0.33 | 0.38 |
| F | 0.02 | 0.03 | 21.97 | 1.26 | 15.69 | 60.33 | 0.15 | 0.35 | 0.03 | 0.26 | 0.38 |
| G | 0.02 | 0.01 | 22.30 | 1.09 | 14.08 | 61.99 | 0.12 | 0.14 | 0.04 | 0.29 | 0.33 |
| 2 | 0.05 | 0.05 | 23.46 | 1.36 | 15.14 | 59.03 | 0.45 | 0.37 | 0.36 | 0.23 | 0.21 |
| 3 | 0.04 | 0.06 | 23.87 | 1.44 | 13.59 | 59.97 | 0.51 | 0.47 | 0.33 | 0.35 | 0.24 |
| 4 | 0.034 | 0.05 | 23.29 | 1.68 | 14.39 | 59.56 | 0.41 | 0.20 | 0.12 | 0.37 | 0.37 |
| 5 | 0.05 | 0.05 | 23.41 | 1.50 | 15.57 | 58.73 | 0.29 | 0.12 | 0.06 | 0.40 | 0.29 |
| 6 | 0.05 | 0.05 | 23.46 | 1.19 | 14.74 | 59.12 | 0.39 | 0.17 | 0.14 | 0.34 | 0.34 |

*includes Tantalum, if any

TABLE V

| Alloy | Si, % | Ti, % | Ratio, Si/Ti | Service Life In Months in Air at 2130° F. | Mass Change 2000° F., 2000° F. 984 hr. mg/cm$^2$ |
|---|---|---|---|---|---|
| A | 0.17 | 0.38 | 0.47 | 1 | −79.9 |
| B | 0.18 | 0.38 | 0.47 | — | −22.2 |
| F | 0.15 | 0.38 | 0.39 | 2 | — |
| G | 0.12 | 0.33 | 0.36 | — | −88.6 |
| 2 | 0.45 | 0.21 | 2.14 | 4 | 2.0 |
| 3 | 0.51 | 0.74 | 2.13 | 3* | 2.5 |
| 4 | 0.41 | 0.37 | 1.11 | 7* | — |
| 5 | 0.29 | 0.29 | 1.00 | — | 3.0 |
| 6 | 0.39 | 0.34 | 1.15 | — | 2.8 |

*Test still in progress

It will be observed that with silicon to titanium ratios in accordance with the invention, service life was appreciably extended.

Given the foregoing, including the data in Tables I–V, it will be noted that the subject invention provides nickel-chromium alloys which afford a combination of desirable metallurgical properties including (1) good oxidation resistance at elevated temperatures (2) high stress-rupture lives at such temperatures, and (3) a relatively stable microstructure. The alloys are characterized by (4) a substantially uniform distribution of titanium nitrides (TiN) throughout the grains and grain boundaries. The nitrides are stable in the microstructure up to near the melting point provided at least 0.04% nitrogen is present. A nitrogen level down to 0.035% might be satisfactory in certain instances. This is in marked contrast to the $M_{23}C_6$ type of carbide which tends to go back into solution at around 2125°–2150° F. (1163°–1177° C.) whereupon nothing remains to control grain size. It is to advantage that (5) the grain size not exceed about 15 mils, preferably being not more than 12 mils, the size of the grains being uniform outwardly to the alloy surface.

While the alloy of the present invention has been described in connection with the behavior of rollers in furnaces for frit production, the alloy is also deemed useful for heating elements, ignition tubes, radiant tubes, combustor components, burners, heat exchangers, furnace fixtures, mufflers, belts, etc. The metal and ceramic process industries, chemical manufactures and the petroleum and petrochemical processing industries are illustrative of industries in which the alloy of the invention is deemed particularly useful.

The term "balance iron" or "balance essentially iron" does not exclude the presence of other elements which do not adversely affect the basic characteristic of the subject alloy, including incidentals, e.g., deoxidizing elements, and impurities ordinarily present in such alloys. An alloy range for a given constituent may be used with the range or ranges given for the other elements of the alloy.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

The embodiments of the invention in which an exclusive property or privilege is claimed are defined as follows:

1. A high nickel-chromium alloy characterized by (a) enhanced resistance to oxidation at elevated temperature, (b) good stress rupture life at such temperatures, and (c) a controlled grain size, said alloy consisting essentially of about 55 to 65% nickel, about 19 to 28% chromium, about 0.75 to 2% aluminum, about 0.2 to 1% titanium, about 0.04 to 0.1% nitrogen, up to about 0.1% carbon, up to 1% each of silicon, molybdenum, manganese and niobium, up to 0.1% boron, and the balance essentially iron.

2. The alloy set forth in claim 1 containing about 58 to 63% nickel, 21 to 25% chromium, 1 to 2% aluminum, 0.3 to 0.7% titanium, at least one of 0.1 to 0.6% silicon and 0.1 to 0.8% molybdenum, up to 0.6% manganese, up to 0.4% niobium, 0.02 to 0.1% carbon and 0.045 to 0.08% nitrogen.

3. The alloy set forth in claim 1 and characterized by a relatively stable microstructure with titanium nitride being substantially uniformly distributed throughout the grains and grain boundaries.

4. The alloy set forth in claim 2 and characterized by a relatively stable microstructure with titanium nitride being substantially uniformly distributed throughout the grains and grain boundaries.

5. The alloy set forth in claim 2 containing both silicon and molybdenum.

6. As a new article of manufacture, a furnace roller formed from the alloy set forth in claim 1.

7. As a new article of manufacture, a furnace roller formed from the alloy set forth in claim 4.

8. The alloy set forth in claim 1 and containing 0.05 to 0.4% niobium.

9. The alloy set forth in claim 1 and containing at least one of up to 0.1% of calcium and up to 0.1% magnesium.

10. The alloy set forth in claim 4 and containing at least one of up to 0.1% calcium and up to 0.1% magnesium.

11. The alloy set forth in claim 1 in which silicon and titanium are correlated such that the ratio therebetween is about 0.85 to 3.

12. The alloy set forth in claim 3 in which silicon and titanium are correlated such that the ratio therebetween is about 0.85 to 3.

13. The alloy set forth in claim 4 in which silicon and titanium are correlated such that the ratio therebetween is about 0.85 to 3.

14. The alloy set forth in claim 1 in which silicon and titanium are correlated such that the ratio therebetween is about 0.85 to 1.5.

15. The alloy set forth in claim 3 in which the silicon and titanium are correlated such that the ratio therebetween is about 0.85 to 1.5.

16. The alloy set forth in claim 4 in which the silicon and titanium are correlated such that the ratio therebetween is about 0.85 to 1.5.

17. The alloy set forth in claim 1 in which the silicon content is about 0.25 to 1%.

18. A high nickel-chromium alloy characterized by (a) enhanced resistance to oxidation at elevated temperature, (b) good stress rupture life at such temperatures, and (c) a controlled grain size, said alloy consisting essentially of about 55 to 65% nickel, about 19 to 28% chromium, about 0.75% to 2% aluminum, about 0.2 to 1% titanium, about 0.035 to 0.1% nitrogen, up to about 0.1% carbon, from 0.2 to 1.5% silicon, and the balance essentially iron, said alloy being further characterized by a relatively stable microstructure having titanium nitrides substantially uniformly distributed throughout the grains and grain boundaries and with the average grain size not exceeding about 15 mils.

19. The alloy set forth in claim 18 in which the respective percentages of silicon and titanium are correlated such that the ratio therebetween is from 0.75 to 3.

20. The alloy set forth in claim 18 in which the said ratio is from 0.85 to 1.5.

* * * * *